US006215056B1

(12) United States Patent
Liao

(10) Patent No.: US 6,215,056 B1
(45) Date of Patent: Apr. 10, 2001

(54) ADJUSTABLE FOOT STRUCTURE FOR HI-HAT CYMBAL

(76) Inventor: Tsun-Chi Liao, No. 14, Chin-Kung Rd. Pei-Tun Dist., Taichung City (TW)

( * ) Notice: Subject to any disclaimer, the term of this patent is extended or adjusted under 35 U.S.C. 154(b) by 0 days.

(21) Appl. No.: 09/670,557

(22) Filed: Sep. 27, 2000

(51) Int. Cl.[7] ..... G10C 3/12
(52) U.S. Cl. ..... 84/422.3; 84/422.1
(58) Field of Search ..... 84/422.1, 422.2, 84/422.3, 453

(56) References Cited

U.S. PATENT DOCUMENTS 5,717,152 * 2/1998 Liao ..... 84/422.3
6,049,032 * 4/2000 Liao ..... 84/422.3
6,096,958 * 8/2000 Liao ..... 84/422.3
6,147,288 * 11/2000 Liao ..... 84/422.1

* cited by examiner

*Primary Examiner*—Jeffrey Donels
*Assistant Examiner*—Kim Lockett
(74) *Attorney, Agent, or Firm*—Bacon & Thomas, PLLC

(57) ABSTRACT

An adjustable foot structure for hi-hat cymbal includes a base and a movable foot pivotally engaging with the base and a cymbal stand. The base has a stub located at one end and a frame at another end. The movable foot includes a rod which has a screw section at one end and a transverse hole at another end, an adjust ring engageable with the screw section for adjusting a adjust knob to make contact with ground surface, a linkage means having a linkage beam which has one end pivotally engaged with a first anchor member and another end pivotally engaged with a second anchor member, and a sleeve located above a step opening formed in the frame for pivotally engaging with the tube of the cymbal. The first anchor member engages with the stub. The second anchor member is pivotally engaged with the rod. The sleeve has two rod fingers pivotally engaging with the transverse hole. The movable foot may form an adjustable angular engagement with the stub through the linkage means. The rod may be turned about the tube through the sleeve for folding the movable foot for storing or extending outward for use.

3 Claims, 7 Drawing Sheets

ADJUSTABLE FOOT STRUCTURE FOR HI-HAT CYMBAL

BACKGROUND OF THE INVENTION

This invention relates to a hi-hat cymbal and particularly a hi-hat cymbal that has a dual-foot or tripod cymbal stand, which may be flexibly positioned on various performing, sites for use.

FIG. 1 shows a conventional hi-hat cymbal, which has a tripod stand supporting two cymbals at the top end and a foot, pedal at the bottom. By stepping the foot pedal, the two cymbals may be actuated to hit against each other for producing sound desired. The tripod stand has three feet, which may be extended around a circular perimeter to securely hold the cymbals on the floor.

The hi-hat cymbal usually has to couple with drum set at the performance sites, and they take relatively large floor space. When performance sites are outdoors on grass field or with no even ground surface, the three feet of the tripod stand cannot stand steadily.

How to resolve the problem set forth above for the hi-hat cymbal to be firmly supported on any performance sites without taking too much floor space is one of the issues musical instrument manufacturers are now pursing.

SUMMARY OF THE INVENTION

It is an object of this invention to provide an adjustable foot structure for hi-hat cymbal that has a base and a movable foot which may be folded for storing and extended for use, and may be adjusted to form different configurations to suit different performance sites to support the hi-hat cymbal steadily.

It is another object of this invention to provide an adjustable foot structure for hi-hat cymbal that has a base and a movable foot which may be folded for storing and extended for use, and may be coupled with a drum set to facilitate playing.

In order to achieve aforesaid objects, the adjustable foot structure according to this invention includes a base, a cymbal stand and a movable foot pivotally engaged with the base and cymbal stand. The base has a stub at one end and a frame at another end. The movable foot includes a rod which has a screw section at one end and a transverse hole at another end, an adjustable knob and an adjusting ring engaged respectively with the screw section, a linkage means having a linkage beam which has two ends respectively and pivotally engaged with a first anchor member and a second anchor member for engaging with the stub and rod, and a sleeve located above an opening of the frame for pivotally holding the tube. The sleeve has two fingers for pivotally engaging with the transverse hole of the rod.

By means of the structure set forth above, the adjust knob may rest on the ground and the rod may be swiveled about the tube through the sleeve, and the movable foot and the stub form an adjustable angular connection through the linkage means such that the movable foot may be folded for storing or extended for use.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

Figure 1:
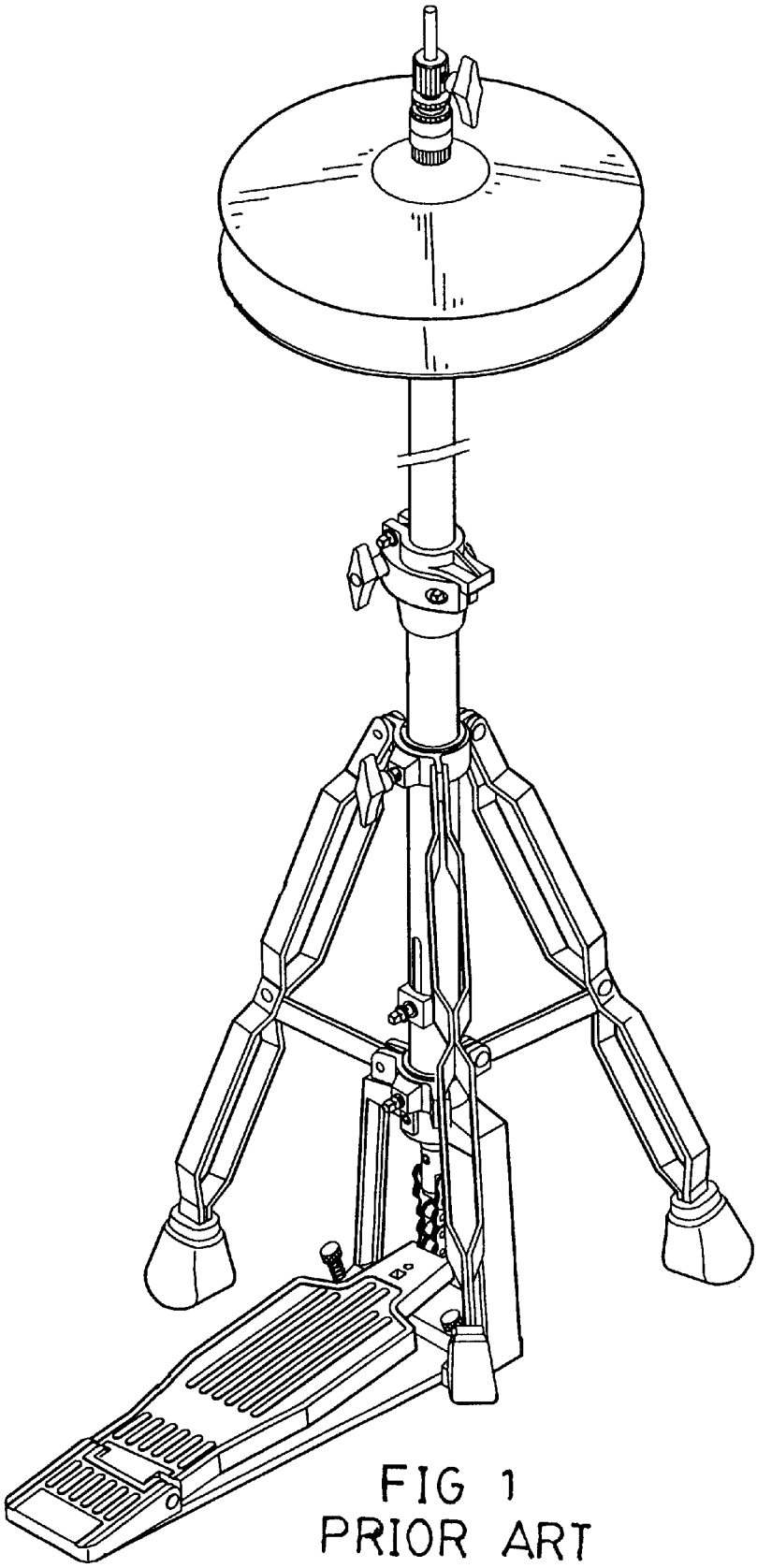
FIG 1 PRIOR ART
FIG. 1 is a perspective view of a conventional hi-hat cymbal.
Figure 2:
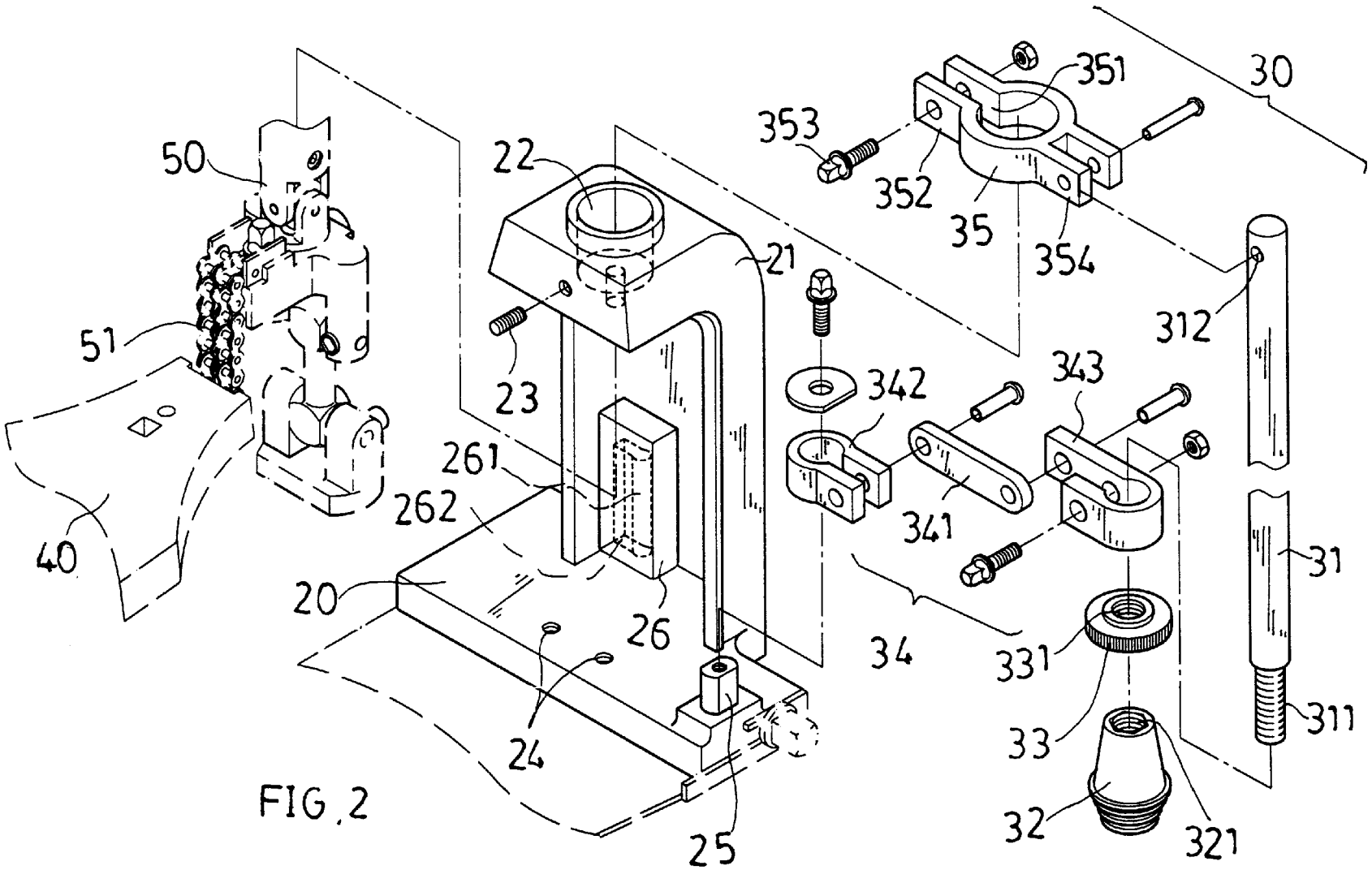
FIG. 2 is an exploded view of this invention.

Referring to FIG. 2 through 7, the adjustable foot structure according to this invention includes a stand 10, a base 20 located below the stand 10 and a movable foot 30 pivotally engaged with stand 10 and base 20.

The stand 10 includes a tube 13, two feet 11 pivotally engaged with the tube 13 through a stand sleeve 12 mounted on the stand 10. The stand sleeve 12 has an adjust screw bolt 14 for securely holding the stand sleeve 12 on the tube 13. The adjust screw bolt 14 forms respectively a same selected angle with each of the two feet 11.

The base 20 is located below the stand 10 and engages with a foot pedal 40. The base 20 includes a frame 21, which is formed like a reversed L shape manner. Between the base 20 and frame 21, there is a swivel block 50, which engages with the foot pedal 40 through a chain 51. Stepping the foot pedal 40, the two cymbals may be driven to hit against each other for making sound. The frame 21 has a top end in which a step opening 22 is provided for holding the tube 13 and a center rod 15. At one side of the frame 21, there is a set screw 23 for engaging the tube 13 and center rod 15 securely in the step opening 22. At one end of the base 20, there are two screw apertures 24 for fixing the swivel block 50 on the base 20 by means of screw bolts. At another side of the base 20, a stub 25 is provided. At a side wall of the frame 21, there is a protrusive block 26 which has a cavity 261 formed therein. The cavity 261 has a top closed end and an opening at the bottom thereof. The protrusive block 26 has a transverse groove 262 communicating with the cavity 261. In the cavity 261, there is a pin 263 which is engaged with a transverse set screw 264 for adjusting the extended outside length of the pin 263.

The movable foot 30 includes a rod 31, an adjust knob 32, an adjust ring 33, a linkage means 34 and a sleeve 35. The rod 31 has a screw section 311 at one end which has screw threads formed thereon and a transverse hole 312 formed at another end.

The adjust knob 32 has an internal screw threads 321 engageable with the screw section 311 so that the adjust knob 32 may become a support pad to make contact with the ground to prevent the movable foot 30 from wearing off against the ground.

The adjust ring 33 has a center screw bore 331 engageable with the screw section 311 for adjusting the position of the adjust knob 32 to make contact with the ground.

The linkage means 34 includes a linkage beam 341 which has two ends pivotally engaged with a first anchor member 342 and a second anchor member 343. The first anchor member 342 is engaged with the stub 25 while the second anchor member 343 is pivotally engaged with the rod 31. Thereby the angle between the movable foot 30 and stub 25 is changeable through the linkage means 34.

The sleeve 35 is located above the step opening 22 of the frame 21 for pivotally holding the tube 13. It has a slot 351 at one side between a pair of clamp fingers 352 which may engage with a clamp screw 353 for fixing the sleeve 35 tightly on the tube 13 or for loosely engaging the sleeve 35 on the tube 13 so that the sleeve 35 may be turned about the tube 13. The sleeve 35 has a pair of rod fingers 354 at another side for pivotally engaging with the transverse hole 312 so that the rod 31 is pivotally turnable about the tube 13 through the sleeve 35.

Figure 3:
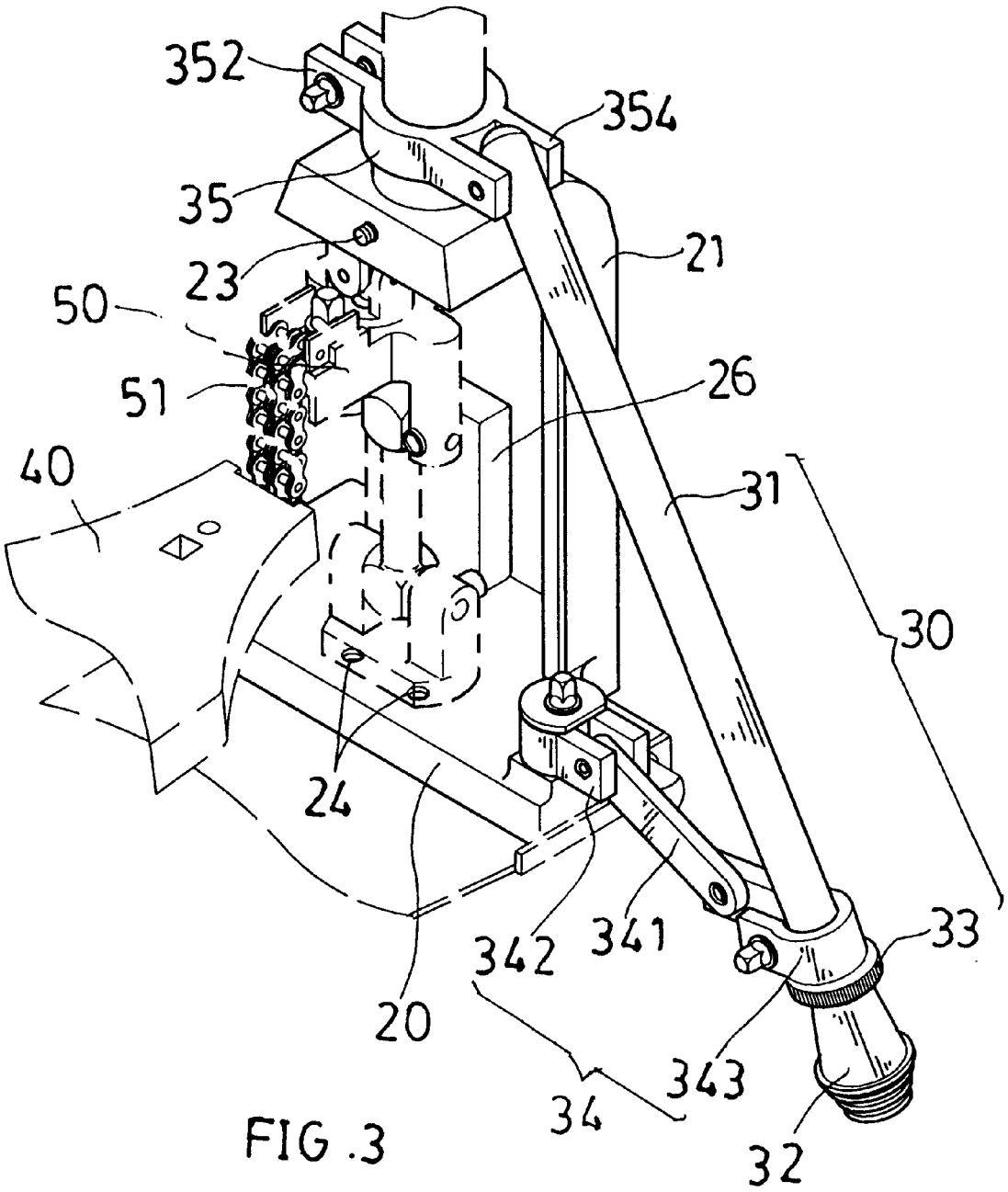
FIG. 3 is a perspective view of this invention.
Figure 4:
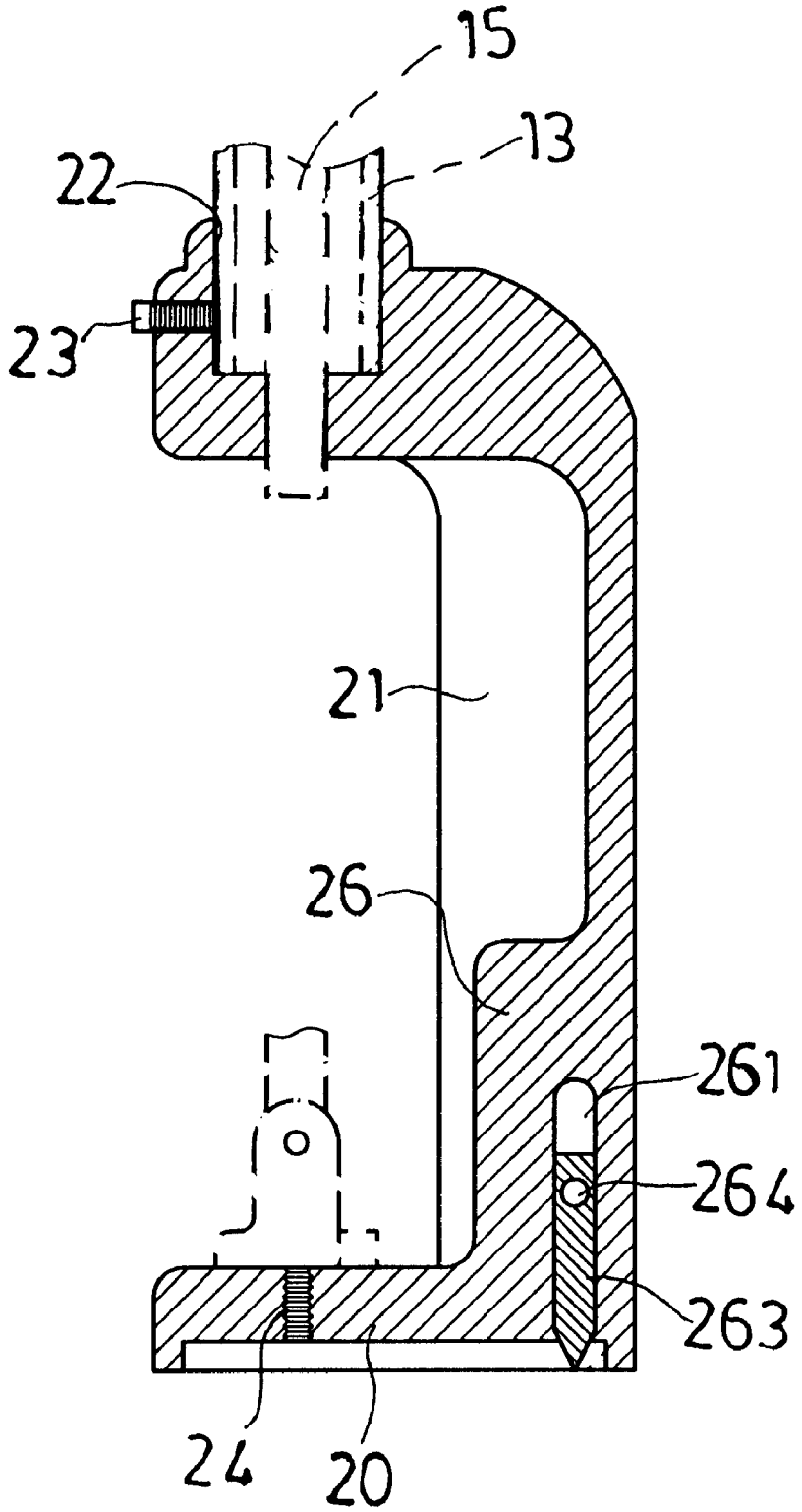
FIG. 4 is a sectional view of a base of this invention.
Figure 5:
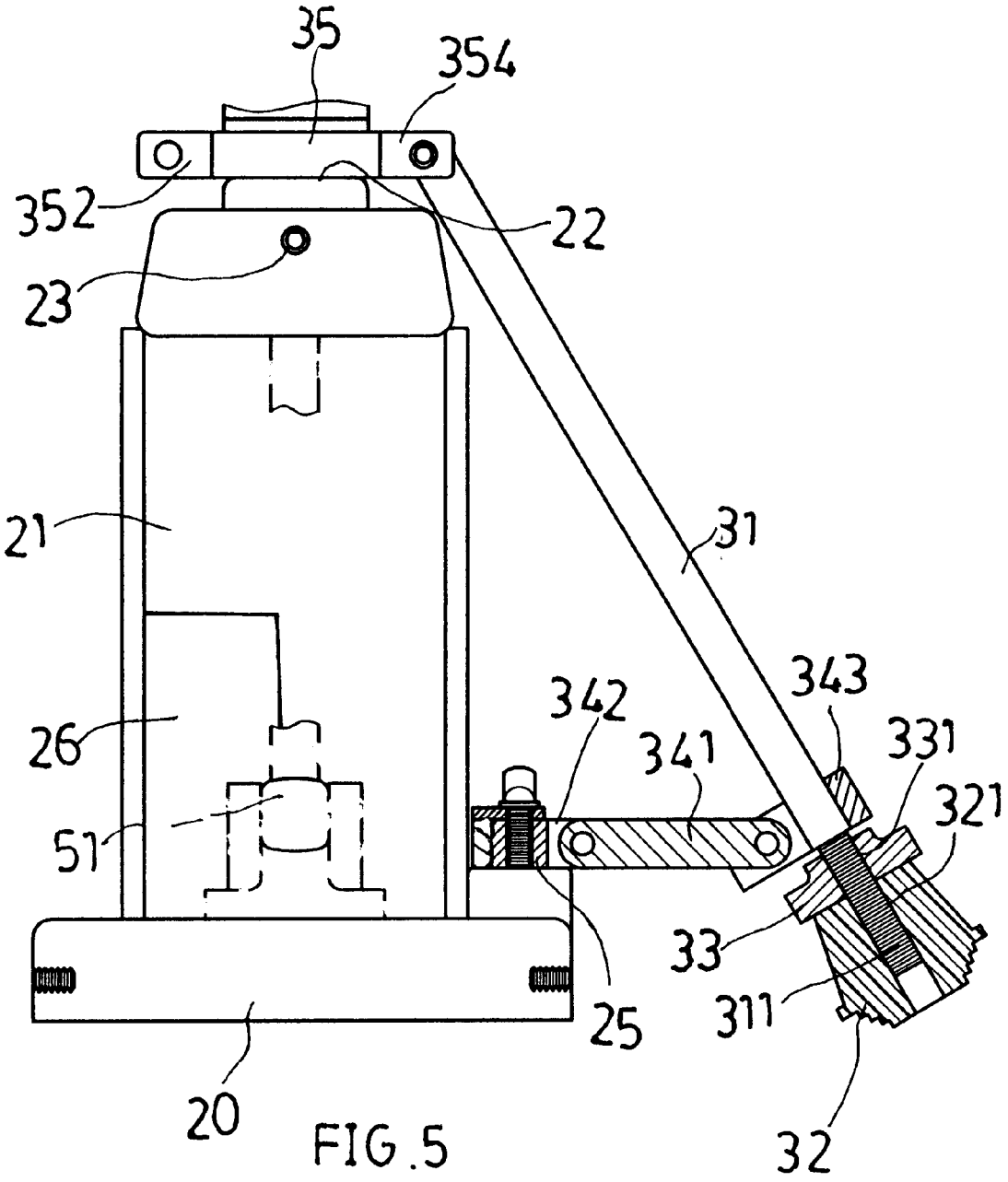
FIG. 5 is a sectional view of a linkage means of this invention.
Figure 6:
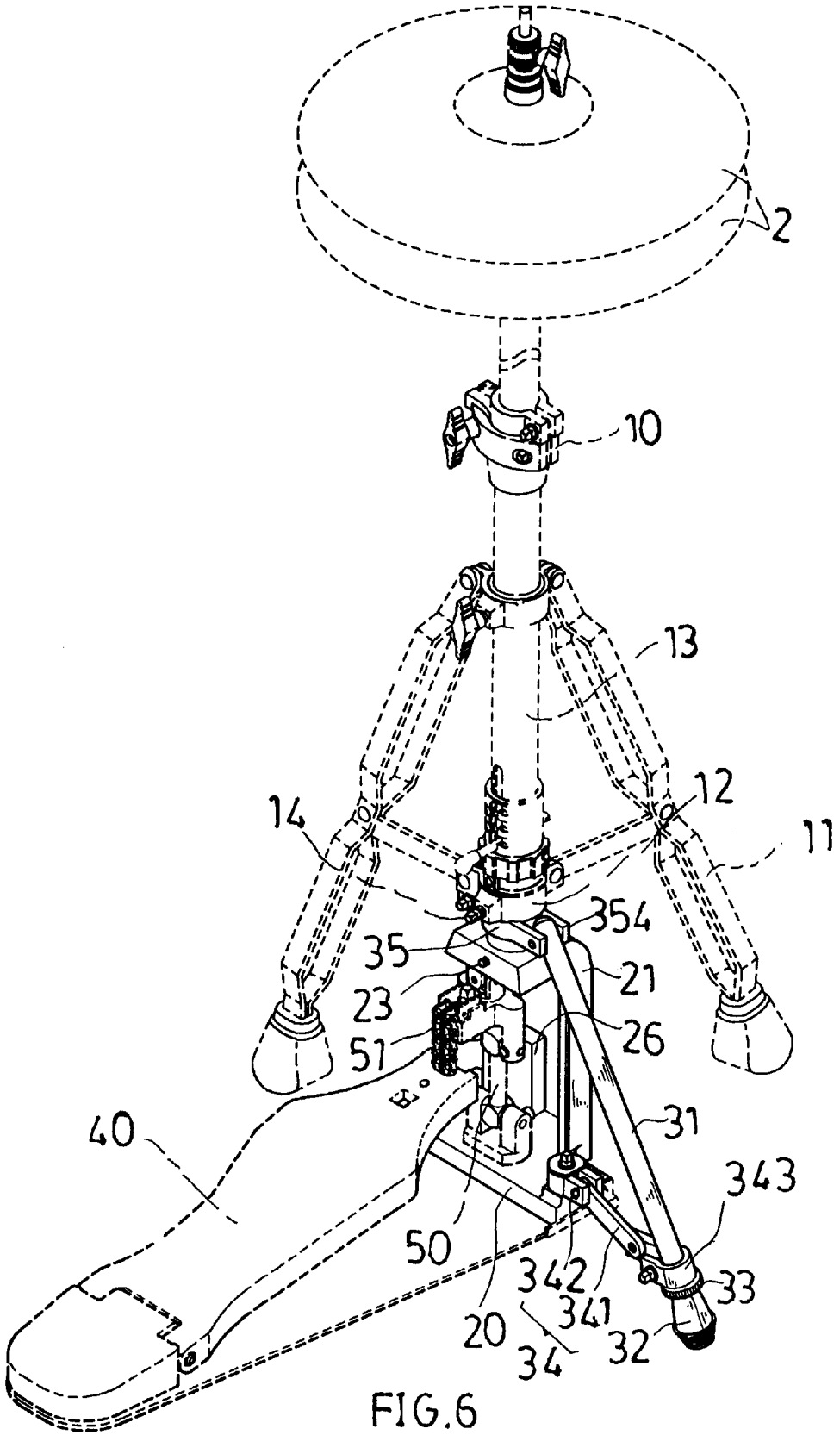
FIG. 6 is a pictorial view of this invention in use.
Figure 7:
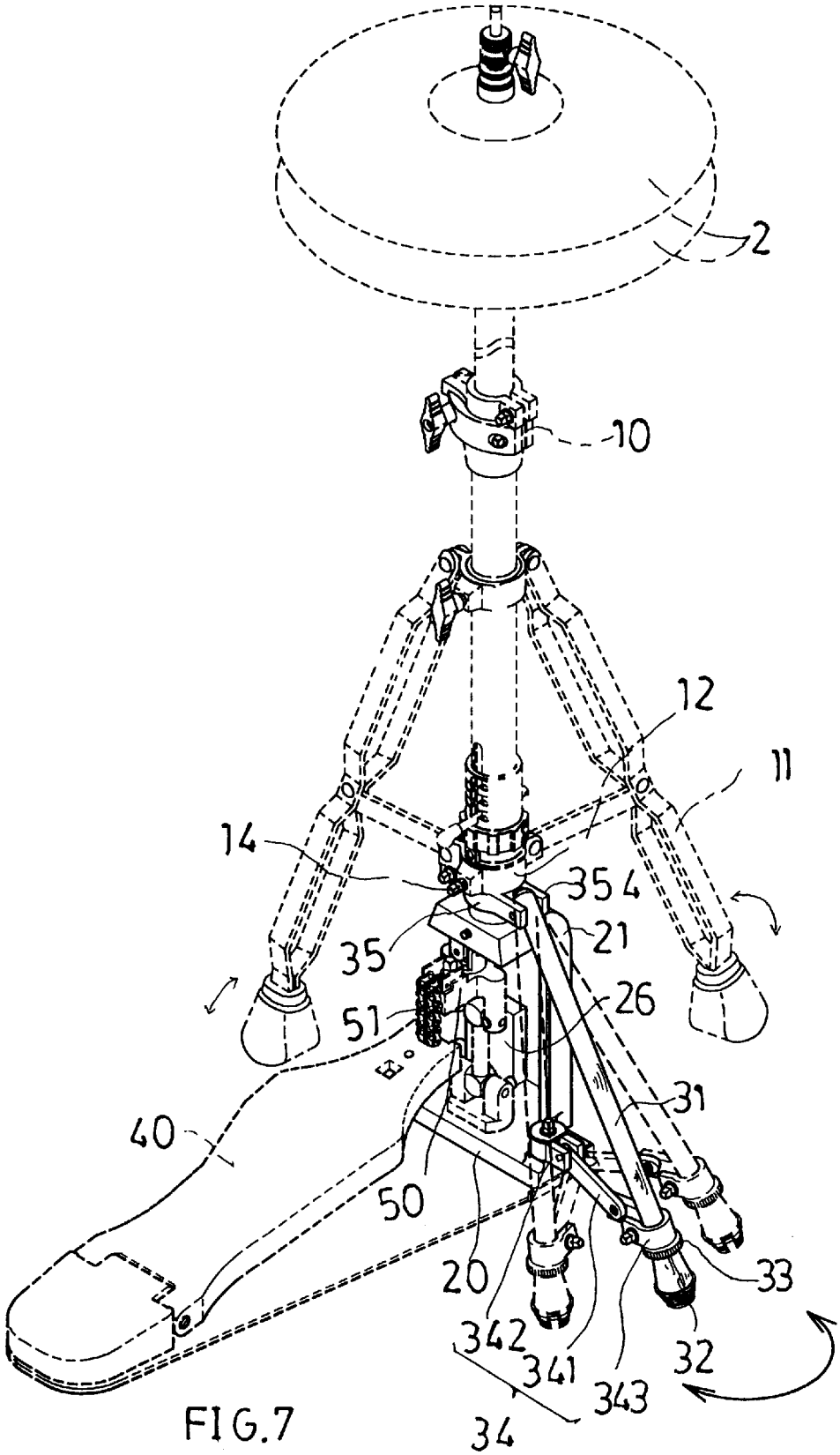
FIG. 7 is a pictorial view of this invention in moving.

Referring to FIG. 3, the rod 31 has one end pivotally engaged with the sleeve 35 and another end pivotally engaged with the stub 25 through the linkage means 34. The movable foot 30 hence may be turned about the base 20. This may be accomplished by loosing the clamp screw 353 in the sleeve 35 to move the movable foot 30 to a position desired. Thereafter tightening the clamp screw 353 to fix the movable foot 30, then turn the adjust ring 33 to make the adjust knob 32 making contact with the ground.

This invention may be used in various ground conditions. At normal conditions, the two feet 11 of the stand 10 may couple with the movable foot 30 to form a tripod stand for supporting the cymbal steadily on the ground. On an uneven ground or a restrained space, the sleeve 35 may be loosened by unscrewing the clamp screw 353 to move the movable foot 30 close and folding behind the frame 21. Then tightening the clamp screw 353 to fix the movable foot 30. Then turning the adjust ring 33 to move the adjust knob 32 away from the ground. Thereafter, loosening the adjustable screw bolt 14 to adjust the two feet 11 and foot pedal 40 to form a standing position on a grass or uneven ground, without the need of finding a supporting position for the third foot like a conventional tripod cymbal stand does.

What is claimed is:

1. An adjustable foot structure for a hi-hat cymbal, comprising:

a stand having a tube, a center rod, a stand sleeve pivotally mounted on the tube and two feet, a base having a substantially reverse L-shaped frame located thereon and extended upward, a swivel block located between the base and frame, two screw apertures at one side thereof for fastening the swivel block on the base, and a stub located at another side thereof, the frame having a step opening formed in an upper end thereof for holding the tube and center rod therein, and a set screw at a selected location in a side wall of the frame for fastening the tube and center rod in the step opening, and a movable foot pivotally engaged with the stand and base, including:

a rod having a screw section at one end formed with screw threads and a transverse hole located at another end thereof, an adjust knob having an internal screw thread engageable with the screw section for protecting the movable foot from wearing contact with ground surface, an adjust ring having a center screw bore engageable with the screw section for adjusting the adjust knob to make contact with the ground surface, a linkage means having a linkage beam which has one end pivotally engaged with a first anchor member and another end pivotally engaged with a second anchor member, the first anchor member being engageable with the stub and the second anchor member being pivotally engaged with the rod such that the movable foot and stub form an adjustable angular engagement through the linkage means, and a sleeve located above the step opening for pivotally engaging with the tube having a pair of clamp fingers at one end thereof fastenable by a clamp screw for setting engagement condition with the tube and a pair of rod fingers at another end thereof for pivotally engaging with the transverse hole such that the rod is turnable about the tube through the sleeve.

2. The adjustable foot structure for a hi-hat cymbal according to claim 1, wherein the frame has a protrusive block formed on a side wall thereof, the protrusive block has a closed top end round cavity formed therein, a transverse groove formed in a side wall thereof communicating with the cavity, and a pin located in the cavity engageable with a set screw for adjusting extending outward length of the pin.

3. The adjustable foot structure for a hi-hat cymbal according to claim 1, wherein the stand sleeve has only two spots engaging with the two feet and an adjust screw bolt.

* * * * *